US006470653B1

(12) United States Patent
Lutz et al.

(10) Patent No.: US 6,470,653 B1
(45) Date of Patent: Oct. 29, 2002

(54) APPARATUS FOR EXTERNALLY MOUNTING A PREMIUM PACKAGE TO A CEREAL BOX

(75) Inventors: David Stewart Lutz, Maple Grove, MN (US); David R. Strehlow, Maple Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 101 days.

(21) Appl. No.: 09/669,193

(22) Filed: Sep. 25, 2000

(51) Int. Cl.[7] ..... B65B 1/24; B65B 61/20

(52) U.S. Cl. ..... 53/526; 53/136.1; 53/238

(58) Field of Search ..... 53/523, 526, 527, 53/529, 128.1, 36.1, 136.4, 135.1, 173, 238; 206/462, 831

(56) References Cited

U.S. PATENT DOCUMENTS

| | | | | | |
|---|---|---|---|---|---|
| 1,344,664 | A | | 6/1920 | Wander | |
| 2,153,911 | A | | 4/1939 | Benedetti | |
| 2,209,200 | A | | 7/1940 | Hanson | |
| 2,350,418 | A | * | 6/1944 | Ross | 53/526 |
| 2,367,684 | A | * | 1/1945 | Malhoiot | 53/523 |
| 3,454,477 | A | * | 11/1948 | Ray | 53/526 |
| 2,532,857 | A | | 12/1950 | Ricciardi | |
| 2,643,811 | A | | 6/1953 | Bolding | |
| 2,784,539 | A | | 3/1957 | Silver | |
| 2,904,945 | A | * | 9/1959 | Kerr | 53/526 |
| 3,138,906 | A | * | 6/1964 | Amderson | 53/526 |
| 3,207,411 | A | | 9/1965 | Farquhar | |
| 3,240,415 | A | | 3/1966 | Pugh, Sr. | |
| 3,269,091 | A | * | 8/1966 | Martin | 53/526 |
| 3,369,660 | A | | 2/1968 | Hartman | |
| 3,387,762 | A | | 6/1968 | Zupon | |
| 3,389,850 | A | | 6/1968 | Rockefeller | |
| 3,391,847 | A | | 7/1968 | Christine | |
| 3,399,763 | A | | 9/1968 | Stone | |
| 3,526,351 | A | | 9/1970 | Goldstein | |
| 3,587,848 | A | | 6/1971 | Froehlig | |
| 3,679,093 | A | | 7/1972 | Chang | |
| 3,874,554 | A | | 4/1975 | Chang | |
| 4,840,275 | A | | 6/1989 | Faiola et al. | |
| 4,930,637 | A | | 6/1990 | DeRoseau | |
| 4,962,856 | A | | 10/1990 | Carter | |
| 4,964,512 | A | | 10/1990 | Ingram et al. | |
| 4,969,595 | A | | 11/1990 | Teasdale | |
| 5,012,972 | A | | 5/1991 | Nordstrom et al. | |
| 5,021,274 | A | | 6/1991 | Beck et al. | |
| 5,193,671 | A | | 3/1993 | Patterson | |
| 5,379,886 | A | | 1/1995 | Brauner et al. | |
| 5,907,944 | A | * | 6/1999 | Giacoman | 53/238 |
| 6,035,610 | A | * | 3/2000 | Vonderhorst et al. | 53/238 |
| 6,173,833 | B1 | * | 1/2001 | Strehlow | 206/216 |
| 6,298,990 | B1 | * | 10/2001 | Amrod et al. | 206/457 |

FOREIGN PATENT DOCUMENTS

| | | |
|---|---|---|
| FR | 1124150 | 6/1956 |

* cited by examiner

*Primary Examiner*—Stephen F. Gerrity
(74) *Attorney, Agent, or Firm*—John A. O'Toole; Douglas J. Taylor; David Murray

(57) ABSTRACT

An apparatus for disposing a premium package on an exterior panel of a cereal or foodstuff box includes a supply or stacking station, a cereal compressing station, a premium inserting station, a cover applying and sealing station and a conveyor assembly which moves the boxes horizontally from one station to the next. The boxes are stacked in the stacking station positioned over the conveyor assembly and removed serially and individually by transverse members of the conveyor assembly. The compressing station includes a synchronous plunger which engages a previously formed opening or cut out in the box and ensures a suitable space within the box for the premium package. The premium package which is sealed by a first layer of transparent material is installed in the cut out either manually or by a synchronous loader. The sealing station applies a second, larger adhesive, preferably transparent cover over the premium package which secures it to the box.

20 Claims, 7 Drawing Sheets

34
30
32
36
24
140

34
30
26
24
36

12
14
16
18
20
10
24
40
118
30
120
30
30
160

APPARATUS FOR EXTERNALLY MOUNTING A PREMIUM PACKAGE TO A CEREAL BOX

BACKGROUND OF THE INVENTION

The present invention relates generally to an apparatus for securing an accessory to a box for foodstuffs and more specifically to an apparatus for mounting a premium package in an opening in a box for cereal, foodstuff or other consumer product.

As an aid to the marketing of breakfast cereals, it is a common practice of many cereal manufacturers to include a premium in the cereal box to promote the sale of the cereal beyond the marketability of the product itself. It will be appreciated that such promotional devices must meet several requirements. First of all, because the premiums are typically given away with the product, that is, they are provided at no additional cost to the consumer, such devices must be relatively inexpensive. Additionally, such premiums must have the ability to be easily included with the product without disruption of the normal handling of such product. Thus, it is desirable that the promotional product be includable with the product without requiring different boxes, cartons and the like which would increase the cost of such promotion. Similarly, the promotional device should not require special handling or care by the manufacturer and retailer of the product beyond that normally given. Finally and most importantly, the promotional device should have consumer appeal to maximize the promotional value of the device.

Promotional devices include items such as coupons, toys, novelty items and the like which are placed within the product box. It can then be appreciated that the promotional device is hidden. Typically, therefore, access to the promotional device occurs only after consumption of most, if not all, of the product. Thus, the promotional value of the premium is reduced because only facsimile or representations of the premium, appearing on the outside of the box, are visible to the purchaser are available at the time of purchase and customer enjoyment of the premium is delayed.

Inclusion of the premium within the product box is disadvantageous for other reasons. First, as the premium cannot be seen from the outside of the box, it is impossible for the manufacturer to verify that a premium is actually present in any particular box without opening the box and destroying its marketability. Omission of the premium can cause customer dissatisfaction and may actually reduce market appeal of the product. Additionally, in order to promote the sale of the product with a particular premium, the outside of the box must include printing advertising the existence of the premium. Accordingly, it is necessary to inventory a variety of different cartons with different graphics corresponding to the particular premium utilized. Once again, the overall cost of the promotion is increased.

U.S. Pat. No. 5,379,886 represents a significant advancement in the inclusion of promotion premiums in packaging which overcomes many of the shortcomings described above and experienced in the prior art. Nonetheless, it is apparent that improvements in the art of premium packaging and apparatus facilitating such packaging are desirable and the present invention is directed thereto.

BRIEF SUMMARY OF THE INVENTION

An apparatus for disposing a premium package on an exterior panel of cereal or foodstuff box includes a supply or stacking station, a cereal compressing station, a premium inserting station, a cover applying and sealing station and a conveyor assembly which moves the boxes horizontally from one station to the next. The boxes are stacked in the stacking station positioned over the conveyor assembly and removed serially and individually by transverse members of the conveyor assembly. The compressing station includes a synchronous plunger which engages a previously formed opening in the box and ensures a suitable space within the box for the premium package. The premium package which is sealed by a first layer of transparent material is installed in the cut out either manually or by a synchronous loader. The sealing station includes an adjustable pressure plate which holds the premium package in place while a second, larger adhesive and transparent cover is disposed over the premium package and secures it to the box.

It is thus an object of the present invention to provide an apparatus which installs a premium package on a cereal or foodstuff box.

It is another object of the present invention to provide an apparatus wherein various supplying, compressing and sealing stations operate in synchronism.

It is a still further object of the present invention to provide an apparatus for assembling a premium package into a pre-formed opening on a panel of a cereal or foodstuff box.

It is a still further object of the present invention to provide an apparatus for applying a premium package to an opening in a box which is retained thereon by an adhesive cover.

Further objects and advantages of the present invention will become apparent by reference to the following description of the preferred embodiment and appended drawings wherein like reference numbers refer to the same component, element or feature.

DESCRIPTION OF THE PREFERRED EMBODIMENT

Figures 1, 2, 3:
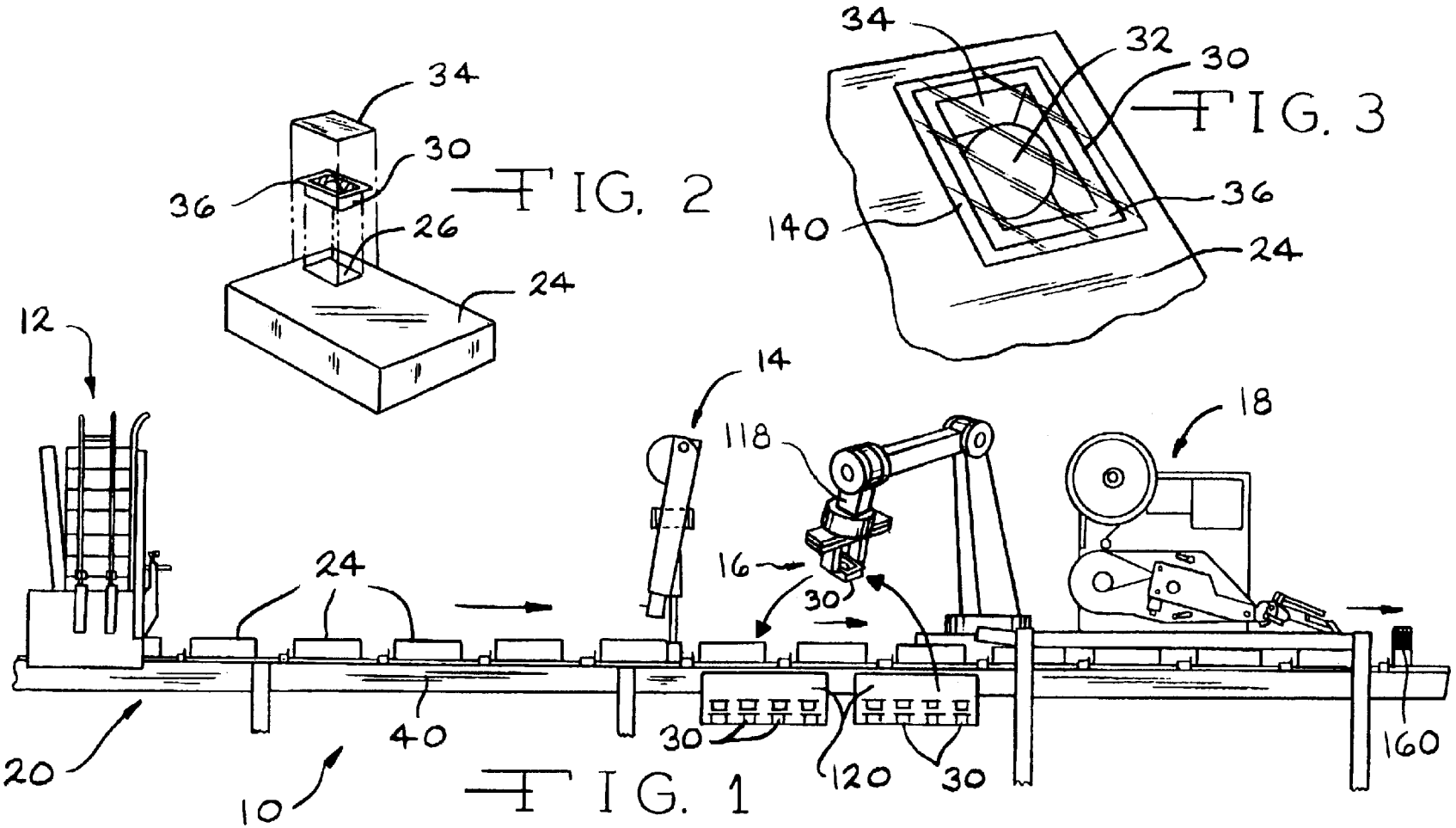
FIG. 1 is a side, elevational view of an apparatus for mounting premium packages in pre-formed opening in cereal boxes.
FIG. 2 is a diagrammatic perspective view of a cereal box showing the physical locations of the premium package and a transparent overlay.
FIG. 3 is fragmentary, enlarged, perspective view of a portion of a cereal box with a premium package disposed therein.

Referring now to FIG. 1, 2 and 3, an apparatus for disposing premium packages in pre-formed openings in cereal boxes is illustrated and generally designated by the reference number 10. The apparatus 10 includes a stacking station 12, a compressing station 14, a premium supplying station 16 and a cover applying and sealing station 18 which are all disposed serially along and proximate a conveyor assembly 20. As noted in FIG. 1, the conveyor assembly 20 moves cartons or boxes 24 for cereal and other foodstuff from left to right. The apparatus 10 accepts, as illustrated in FIGS. 2 and 3, the cereal cartons or boxes 24 which include a pre-formed or pre-existing typically rectangular cut-out or opening 26 which receives a pre-formed package or tray 30 having a premium 32 disposed therein and a transparent overlay 34 secured to a peripheral flange 36 of the tray 30 to retain the premium 32 within the tray 30. The premium 32 may be a coupon, toy, novelty item or additional edible ingredients or toppings.

Figure 4:
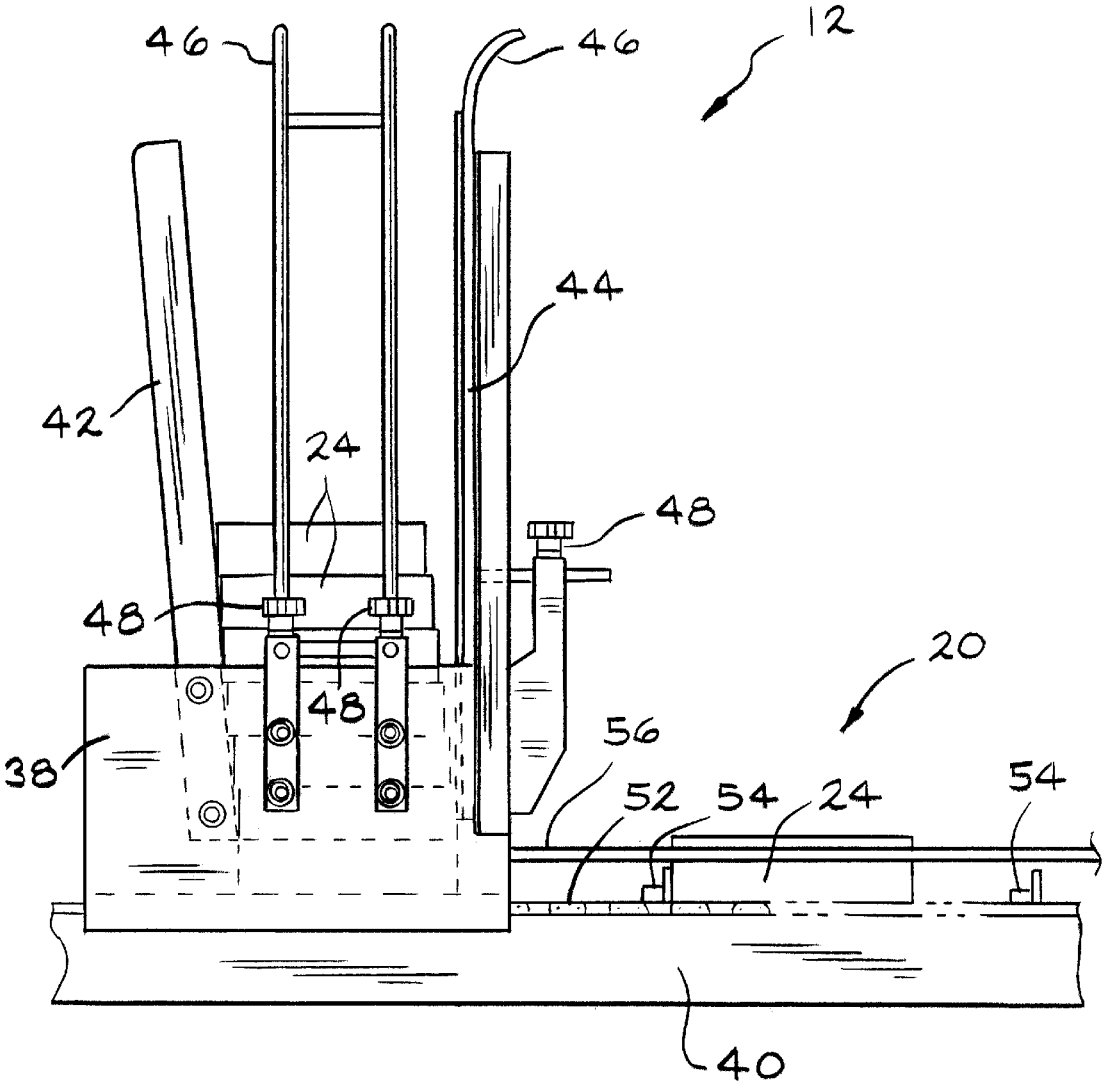
FIG. 4 is a front, elevational view of a carton stacking station of an apparatus according to the present invention.

Referring now to FIG. 4, the stacking station 12 is disposed at one end of the conveyor assembly 20 and includes front and rear rectangular frame members 38 (one of which is illustrated in FIG. 4) which straddle and are secured to respective front and rear longitudinal frame members 40 which form a portion of the conveyor assembly 20. Extending between the front and rear frame members 38 and secured thereto by suitable fasteners is a slightly inclined left guide plate 42 and a pair of adjustable right guide bars 44. Also secured to the front and rear frame members 38 are respective pairs of front and rear guide bars 46. The top of the right guide bar 44 and the front and rear guide bars 46 are curved outwardly. Spacing or separation from an opposed guide bar 46 or the guide plate 42 is adjustable by lockable and releasable adjustment mechanisms 48 in order to adapt the stacking station 12 to receive different sizes of boxes or cartons 24. Cooperatively, the left guide plate 42, the right guide bars 44 and the front and rear guide bars 46 define an adjustable rectangular hopper which receives a plurality of boxes or cartons 24 in a stack as illustrated in FIGS. 1 and 4. It will be appreciated that the stacking station 12 must receive the cartons or boxes 24 in the same orientation with the cut-out or opening or 26 always on the upper panel of the carton or box 24 and always disposed in the same location.

Figures 7, 8:
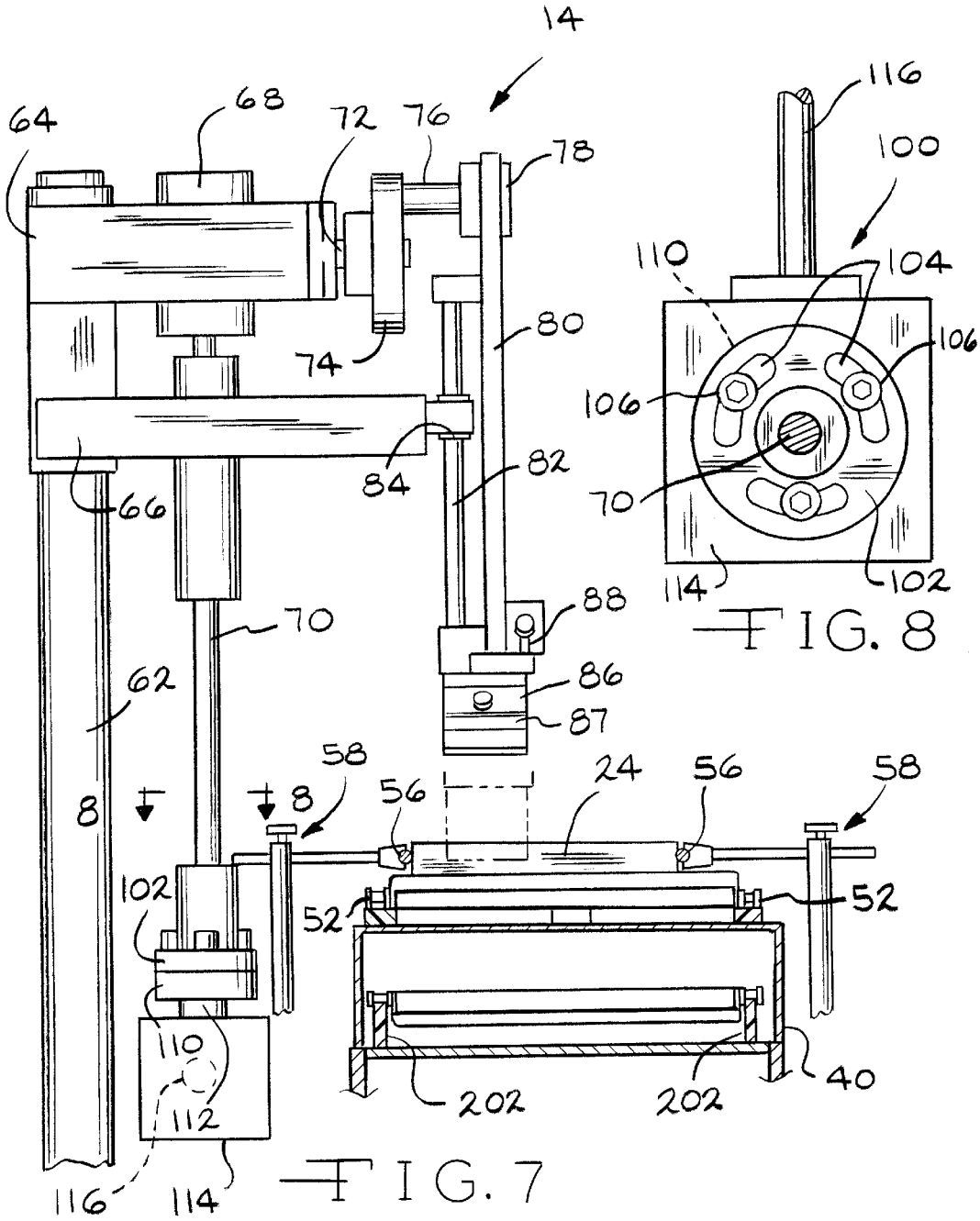
FIG. 7 is a side, elevational view of a compressing station of an apparatus according to the present invention.
FIG. 8 is a full, sectional view of a phase adjusting mechanism of a compressing station of an apparatus according to the present invention taken along line 8—8 of FIG. 7.

As is illustrated in FIGS. 4 and 7, the conveyor assembly 20, includes a pair of front and rear continuous link chains 52 having transversely disposed members 54 secured to the front and rear chains 52 which engage and translate the individual cartons or boxes 24. Front and rear adjustable guide rails 56 which are supported by a plurality of longitudinally spaced apart adjustable stanchion assemblies 58 maintain the boxes or cartons 24 in an appropriate transverse position as they move along the conveyor assembly 20.

Turning now to FIGS. 5, 6, 7 and 8, the compressing station 14 is illustrated and includes a stationary upright support or frame member 62 which is secured to the rear longitudinal frame member 40 of the conveyor assembly 20. The vertical frame member 62 in turn, supports upper and lower cantilever frame members 64 and 66, respectively. The upper cantilever frame member 64 in turn supports a right angle drive assembly 68 which receives rotary power through a vertical shaft 70 and redirects it at a 1:1 drive ratio to a horizontal shaft 72 which terminates in a drive member 74 having an eccentric drive pin 76. The eccentric drive pin 76 is received within a suitable bearing 78 on a reciprocating arm 80. Secured to and spaced from the rear face of the reciprocating arm 80 is a guide rod 82 which is slidably received within a pivotally mounted journal bearing or bushing 84. The pivoting bushing 84 is secured to the lower cantilever frame member 66. At the lower terminus of the reciprocating member 80 is mounted a compression member or plunger 86. The plunger 86 preferably defines a slight downward and inward taper on its side faces and defines width and depth slightly smaller than the corresponding dimensions of the cut-out or openings 26 in the cartons 24. The plunger 86 also includes a travel guide 87 secured to one side wall of the plunger 86 which externally indicates proper travel (penetration) of the plunger 86 into the box 24. It will be appreciated that the plunger 86 is secured to the reciprocating member 80 by removable fasteners 88 such that various sizes of the plunger 86 may be selectively secured to the reciprocating arm 80 to complement a particular size of cut-out or opening 26 in the boxes or cartons 24.

Figure 5:
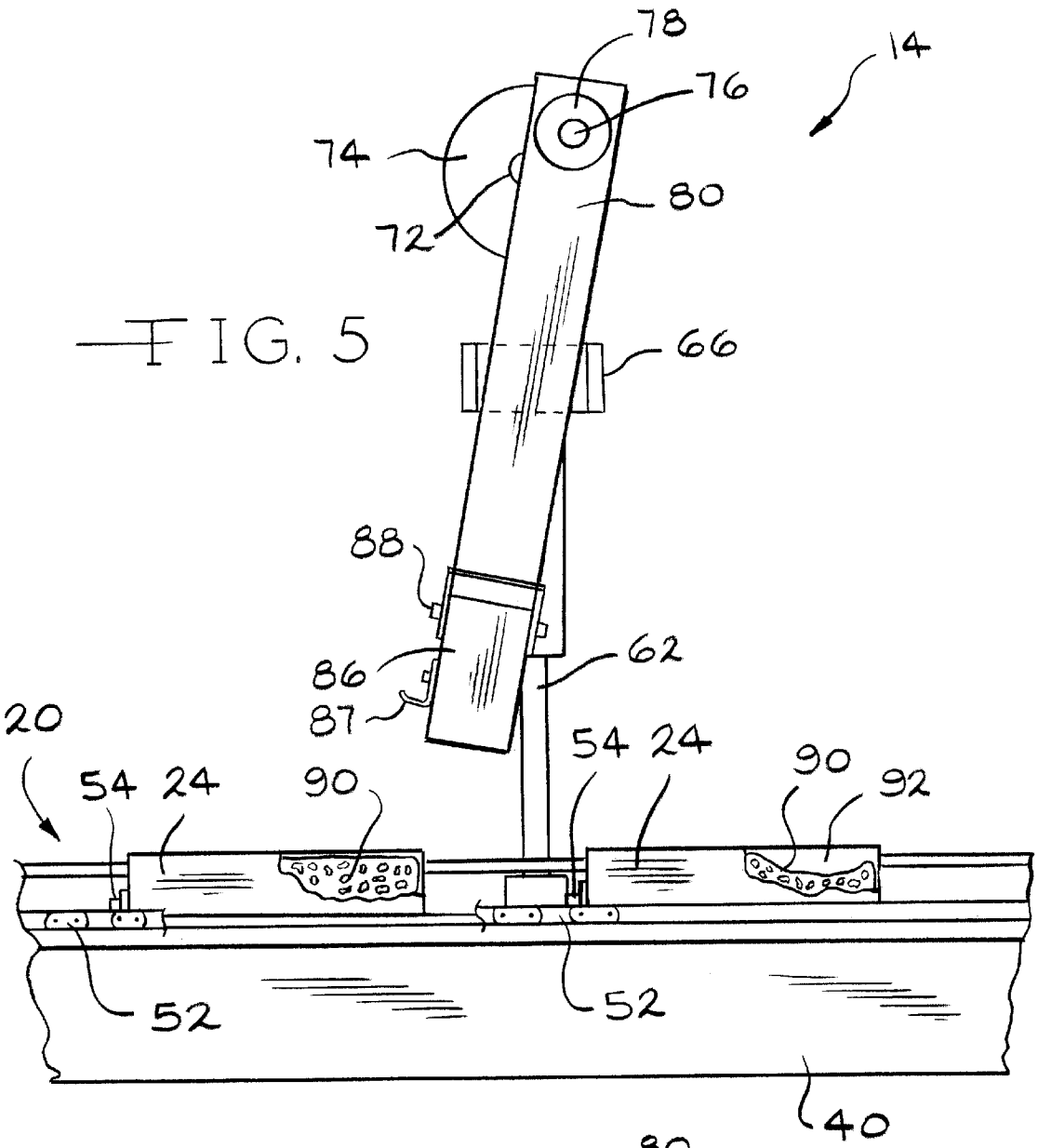
FIG. 5 is a front, elevational view of a compressing station of an apparatus according to the present invention.
Figure 6:
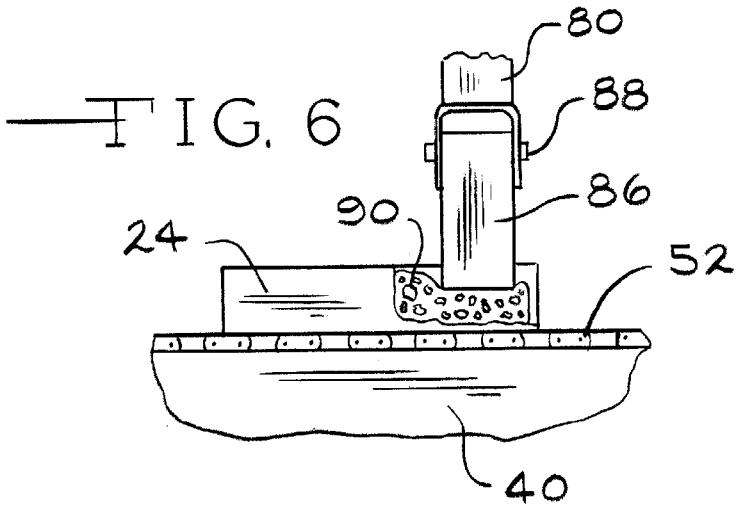
FIG. 6 is a fragmentary, front, elevational view of a compressing station of an apparatus according to the present invention illustrating a plunger extended into a cereal box.

As shown in FIGS. 5 and 6, rotation of the shaft 72 effects reciprocation of the reciprocating arm 80 and the plunger 86 to slightly compress cereal 90 or other foodstuff in the box or carton 24 as the boxes or cartons 24 pass the compression station 12 on the conveyor assembly 20. The box or carton 24 to the left in FIG. 5 illustrates the disposition of the cereal 90 or other foodstuff prior to action at the compression station 14. FIG. 6 illustrates the maximum advance of the plunger 86 into the box or carton 24 and the box or carton 24 on the right in FIG. 5 illustrates the effect of such compression where a depression 92 in the cereal 90 which is directly below the cut-out or opening 26 in the cereal box 24 is visible.

Referring again to FIGS. 7 and 8, the compressing station 14 includes a synchronizing or phase adjusting mechanism 100. The vertical drive shaft 70 terminates in a first or upper flange 102 having a plurality of arcuate slots 104. Received within each of the arcuate slots 104 is a cap screw or similar threaded fastener 106 which extends into a complementarily threaded opening (not illustrated) in a matching second or lower flange 110 which is secured to and driven by an output shaft 112 of a right angle drive assembly 114. An input shaft 116 provides rotary energy to the right angle drive assembly 114. Depending upon the location of the cut out or opening 26 in the box or carton 24 and other variables, it may be necessary to adjust the phase of the reciprocating arm 80 and the plunger 86 relative to the input drive shaft 116. In order to achieve such adjustment, the cap screws 106 are loosened and the upper flange 102 is rotated relative to the lower flange 110. When proper synchronism or phase is achieved, that is, the plunger 86 accurately and repeatedly aligns with and enters the cut-out or opening 26 in each carton or box 24 as they move along the conveyor assembly 20, the cap screws 106 may then be re-tightened.

Referring again to FIG. 1, on the downstream side of the compressing station 14, the trays or packages 30 including the premiums 32 are inserted into the cut-outs 26 of the boxes 24. Such insertion may be achieved manually through the use of skilled workers (not illustrated) or automatically through the use of a pick and place mechanical or robot arm 118. In either event, it will typically be preferable to include one or more bins 120 or other supply device such as a conveyor or stacker (both not illustrated) disposed on or adjacent the front longitudinal frame member 40 of the conveyor assembly 20 to hold and maintain a supply of the packages or trays 30.

Figure 9:
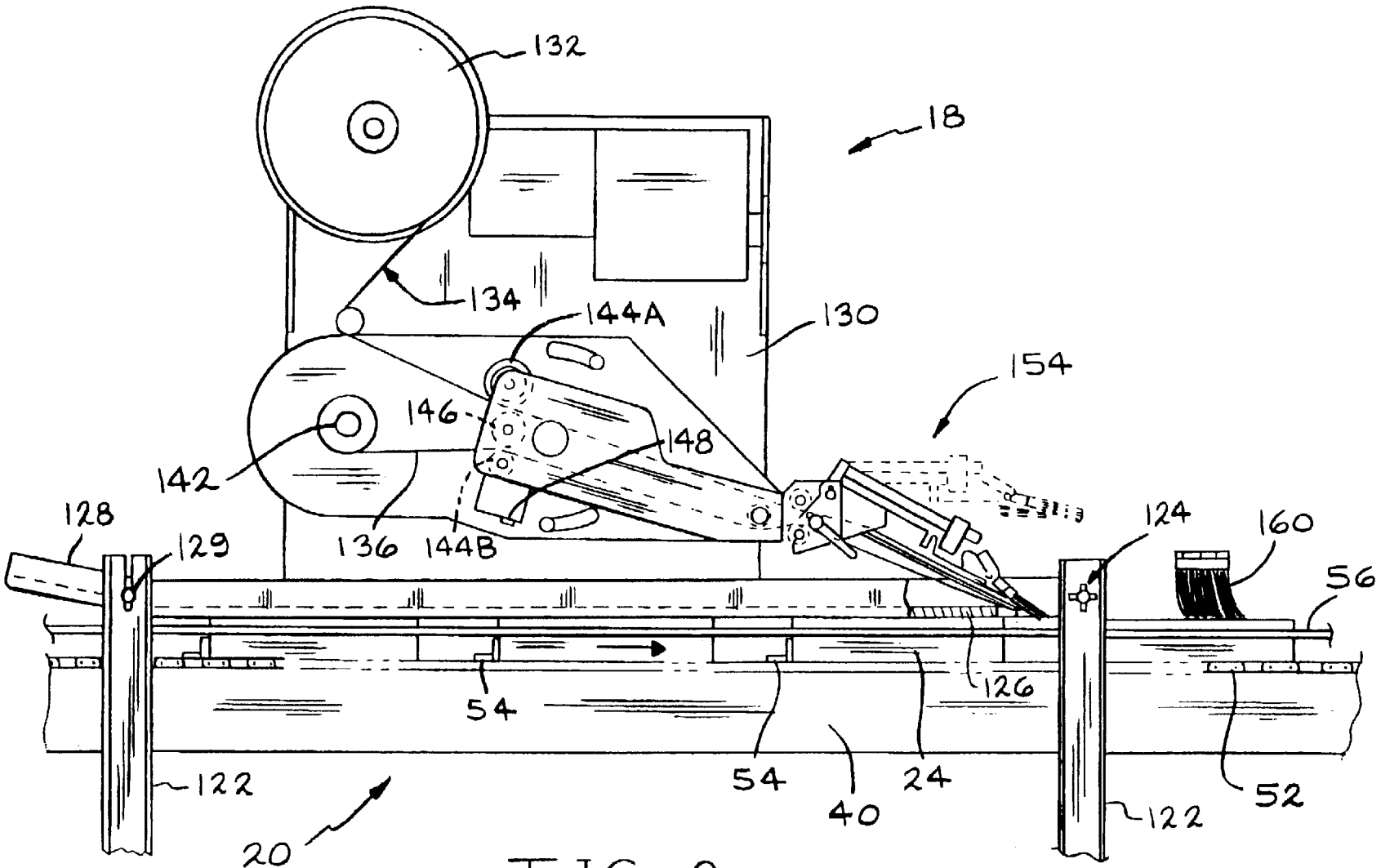
FIG. 9 is a front, elevational view of a labeling/sealing station of an apparatus according to the present invention.
Figure 10:
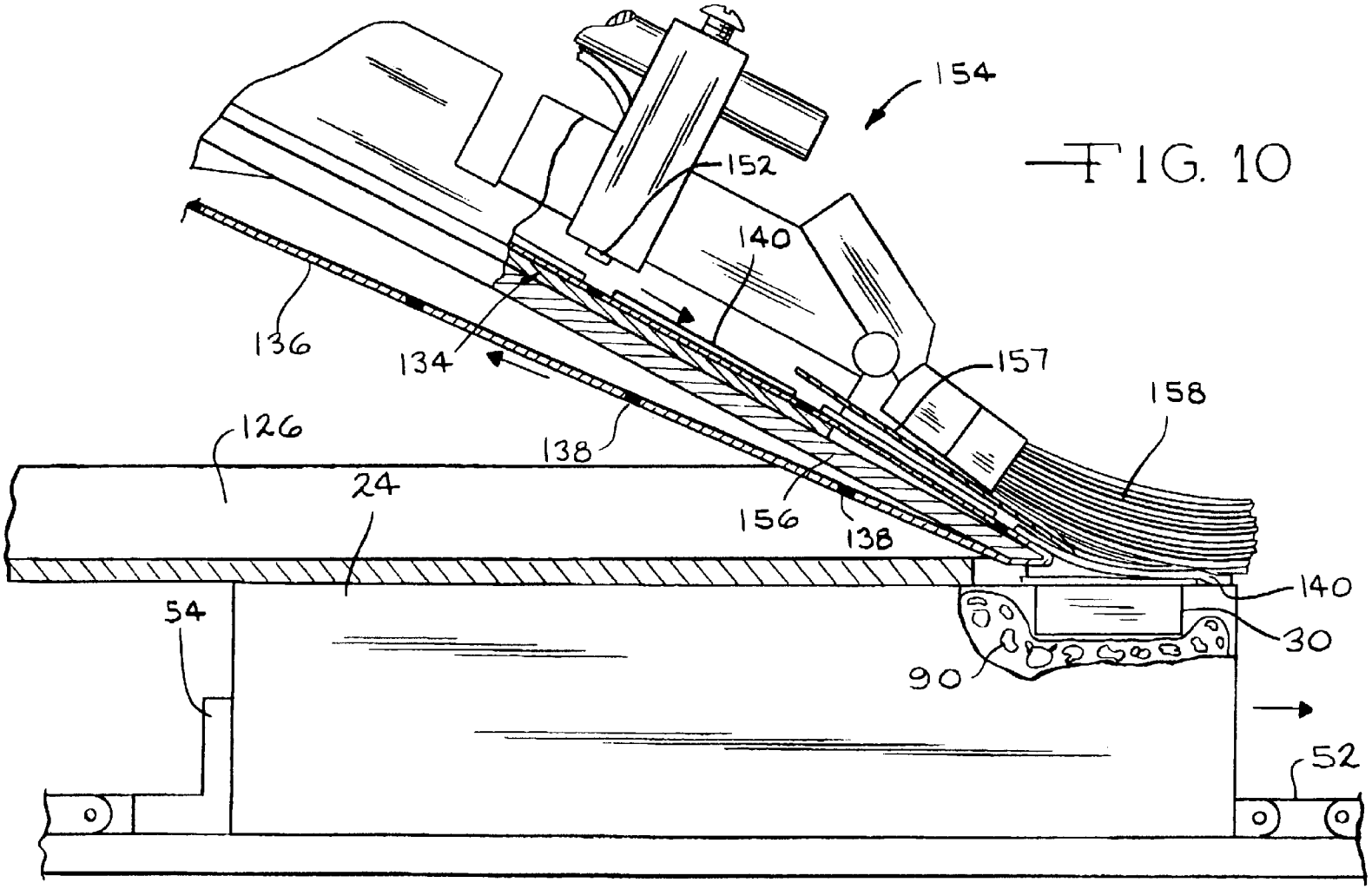
FIG. 10 is an enlarged, fragmentary view of the label-applying portion of an apparatus according to the present invention.

Referring to now to FIGS. 9 and 10, the conveyor assembly 20 next moves the cartons or boxes 24 with the inserted premium trays 30 to the cover applying and sealing station 18. The cover applying and sealing station 18 includes a plurality of vertical supports 122 which may be attached to the longitudinal frame members 40 or otherwise supported. The right vertical supports 122 include height adjustment assemblies 124 such as cooperating slots and thumbscrews which adjustably, vertically position and pivotally secure a restraining plate 126. The restraining plate 126 extends across the width of the conveyor assembly 20 and between the vertical supports 122 and provides a down force to fully or substantially fully seat and retain the premium trays 30 in the cut outs 26 of the boxes 24 as they enter the cover applying and sealing station 18. The restraining plate 126 includes an upwardly angled, oblique portion 128 which forms a tapering throat to ensure that the boxes 24 and the premium trays 30 are properly engaged by the restraining plate 126 and pass thereunder. The left vertical supports 122 receive register pins 129 which extend horizontally from the restraining plate 126, stabilize it and limit its downward travel.

The cover applying and sealing station 18 also includes a frame or housing 130 which supports a feed roll 132 which supplies a two component tape 134. As shown in FIG. 10, the tape 134 includes a continuous, relatively thin and flexible transparent substrate 136 having spaced apart black or opaque transverse bars or markers 138 and thicker, preferably transparent adhesive covers or labels 140 disposed upon the flexible substrate 136 between each of the transverse markers 138. While the covers or labels 140 are preferably transparent so that the premium 32 and the presence of the premium 32 may readily be ascertained, it is anticipated that text, symbols or pictures may also be included on the covers or labels 140. The substrate 136 is recovered and wound upon a discard spool 142 for eventual disposal or recycling. A pair of parallel idler rollers 144A and 144B compressively engage a drive roller 146 and drive the two component tape 134, drawing off the tape 134 from the supply spool 132 and providing the substrate 136 to the discard spool 142.

As illustrated in FIG. 10, in order to ensure proper location of the adhesive cover 140 upon each of the cartons or boxes 24 over the premium package 30, the cover applying and sealing station 18 includes a first sensor 148 which senses the leading edge of each of the cartons or boxes 24. The first sensor 148 is preferably a photoelectric sensor but may be any type of optical, laser or less desirably, a mechanical sensor, capable of accurately and repeatedly providing an output signal or a change in an output signal indicating the arrival of a leading edge of a carton or box 24 at the location of the first sensor 148. A second sensor 152 is disposed on a pivotable application assembly 154 at a location proximate the location where the labels 140 are applied to the cartons or boxes 24. The second sensor 152 is arranged to detect the black or opaque transverse markers 138 on the substrate 136. Preferably, the location of the second sensor 152 is longitudinally adjustable such that the location of the transverse marker 138 at which the second sensor 152 generates a pulse or a change in an output condition may be adjusted to accommodate various size adhesive labels 140 and other variables which may necessitate an adjustment in the timing and thus location of the second sensor 152. The first and second sensors 148 and 152 provide signals to a processor or other control device (not illustrated) which ultimately control a motor driving the drive roller 146.

As also illustrated in FIG. 10, it will be appreciated that the application assembly 154 includes a relatively thin blade or plate 156 over which the dual component tape 134 passes and reverses direction. Preferably, the restraining plate 126 is notched to receive the blade or plate 156 and extends to the right, beyond it in order to achieve maximum stabilization of the cartons 24. An upper guide plate 157 also guides the dual component tape 134 and, with the plate 156, defines a narrow throat through which the dual component tape 134 passes. As the leading edge of a box or carton 24 is sensed by the first sensor 148, and one of the opaque transverse markers 138 is likewise sensed by the second sensor 152, the drive roller 146 is activated to advance the dual component tape 134. As the substrate 136 reverses direction at the end of the blade or plate 156, the transparent adhesive cover 140, because it is relatively thicker and stiffer, continues to the right as illustrated in FIG. 10 and engages the box or carton 24 in the desired location.

It will be appreciated that the adhesive on the covers 140 must provide sufficient adherence to secure the premium package or tray 30 to the box 24 but not so great adherence that it fails to release from the substrate 136 as it curves around the end of the blade or plate 156. In the particular example illustrated, the cover 140 is disposed adjacent the leading edge of the box and beyond the lip of the package or tray 30 such that it engages the top surface of the box 24, thereby sealing the tray 30 to the top surface of the box 24. A pressure-applying device such as a brush 158 or similar flexible, low friction component such as a roller applies a force to the top surface of the cover 140 thereby assisting its securement to the carton or box 24. A second brush 160 or similar pressures applying device such as a roller, downstream of the first brush 158, further smoothes and secures the label 140 to the carton or box 24.

The assembly of the premium package 30 to the carton or box 24 is now complete and the cartons or boxes 24 so configured may be removed from the conveyor assembly 20 and stacked or packaged as necessary.

Figure 12:
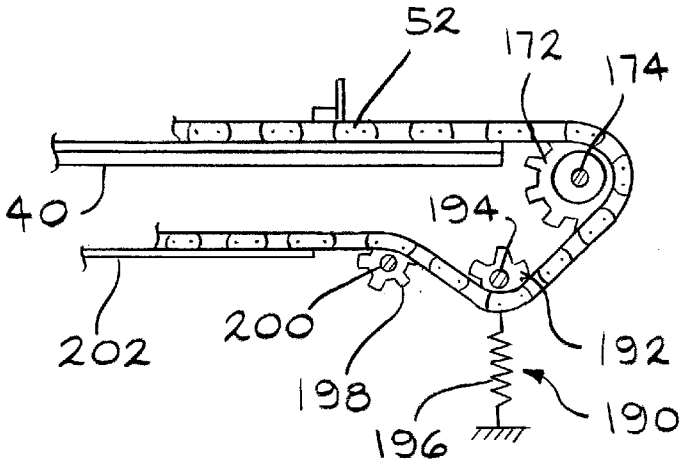
FIG. 12 is a fragmentary, side, elevational view of a conveyor tensioning mechanism of an apparatus according to the present invention.
Figure 11:
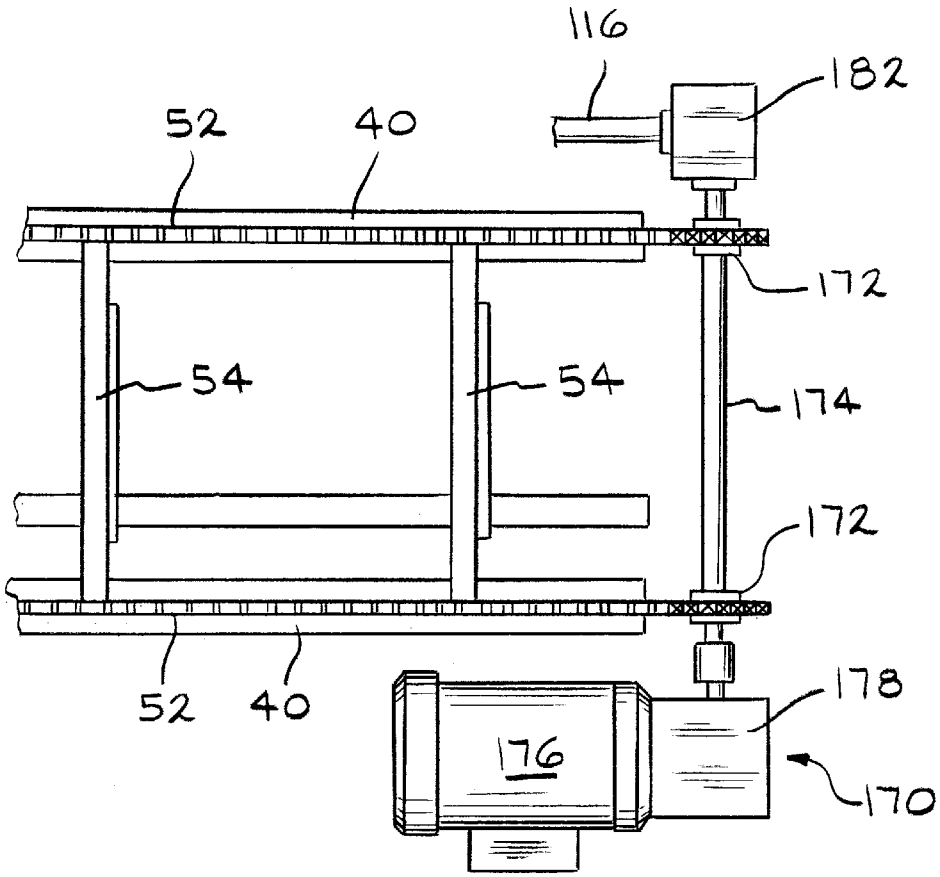
FIG. 11 is a top, plan view of a conveyor drive mechanism of an apparatus according to the present invention.

Referring now to FIGS. 11 and 12, a drive assembly 170 for the conveyor assembly 20 is illustrated. As noted, the conveyor assembly 20 includes pair of parallel chains 52 supported by and translating along the front and rear longitudinal frame members 40. At suitable spaced apart intervals on the chains 22 are secured transverse members 54 which engage and translate the cartons or boxes 24. At one end of the frame members 40, the conveyor chains 52 engage drive sprockets 172 which are secured to a transverse drive shaft 174 driven by an electric motor 176 through a speed reduction unit 178. The drive shaft 174 is also directly coupled to a right angle drive assembly 182 having an output coupled to and driving the drive shaft 116 which provides synchronous drive energy to the compressing station 14 described above and illustrated in FIGS. 5 through 8. By commonly driving the conveyor assembly 20 and the compressing station 14 with the drive assembly 170, synchronism of the action of the plunger 86 relative to the location of the openings 26 in the boxes 24 may be maintained. Moreover, the phase adjustment assembly 100 illustrated in FIG. 8 may be utilized to achieve proper synchronism.

In order to ensure smooth operation of the conveyor assembly 20 and particularly to improve operation of the conveyor assembly 20 at higher production speeds, the conveyor assembly 20 preferably includes a tensioning mechanism 190. The tensioning mechanism 190 includes a pair of idler sprockets 192 which preferably engage the drive chains 52 adjacent the drive sprockets 172. The idler sprockets 192 are disposed upon a transverse shaft 194 which is biased by one or a pair of tension springs 196 in such a manner that any slack or looseness of the drive chains 52 is absorbed. A pair of return idlers 198 mounted upon a transverse shaft 200 guide and direct the drive chains to horizontal return supports or channels 202.

It will be appreciated that although the foregoing description relates to an apparatus for externally mounting a premium package on a cereal or foodstuff box, the apparatus is, of course, not so limited, but has broad utility and applicability with boxes containing virtually any product such as sundries (hair care products, tissues, vitamins and cold remedies), frozen and packaged foods, and other products in highly competitive and impulse purchase markets wherein such a premium may positively influence the purchasing decision.

The foregoing disclosure is the best mode devised by the inventors for practicing this invention. It is apparent, however, that apparatus incorporating modifications and variations will be obvious to one skilled in the art of packaging machines. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. An apparatus for disposing a premium package on an exterior of a box for foodstuff comprising, in combination, a stacking station for receiving and supplying a plurality of boxes, a compressing station for engaging and partially compressing a portion of foodstuff in each of said plurality of boxes, a premium station for disposing a premium package on an exterior of each of said plurality of boxes, a cover applying and sealing station for placing a sealing cover over each of said premium packages on said plurality of boxes, and a conveyor assembly for sequentially engaging and translating said plurality of boxes from said stacking station through said compressing, premium disposing and cover applying and sealing stations.

2. The apparatus of claim 1 further including a drive assembly for synchronously driving said compressing station and said conveyor assembly.

3. The apparatus of claim 1 wherein said conveyor assembly includes a pair of spaced apart circulating chains and a plurality of box engaging spaced apart transverse members secured to said chains.

4. The apparatus of claim 1 wherein said cover applying and sealing station includes a tape having a substrate and a plurality of adhesive covers and a drive mechanism for advancing said tape.

5. The apparatus of claim 1 wherein said stacking station includes a substantially upright wall member and at least two adjustable guide assemblies.

6. The apparatus of claim 1 wherein said compressing station includes a reciprocating plunger adapted to engage an opening in said plurality of boxes.

7. The apparatus of claim 1 further including a drive assembly for said compressing station and said conveyor assembly and a phase adjustment device disposed between said drive assembly and said compressing station.

8. An apparatus for positioning a premium tray on an exterior of a box comprising, in combination, a hopper for receiving a plurality of boxes having contents, a compressing station having a reciprocating plunger for engaging said contents of said plurality of boxes, a premium tray station for disposing a premium tray on each of said plurality of boxes, an applying station for disposing a cover over each of said premium trays to secure each of said premium trays to one of said plurality of boxes, and a conveyor assembly for sequentially moving said plurality of boxes between said stations.

9. The apparatus of claim 8 wherein said conveyor assembly includes a pair of laterally adjustable, spaced apart guide rails.

10. The apparatus of claim 8 further including a drive assembly for driving said compressing station and said conveyor assembly and a phase adjustment device operably disposed between said drive assembly and said compressing station.

11. The apparatus of claim 8 wherein said applying station includes a substrate having a plurality of covers disposed thereon, a drive assembly for advancing said substrate and said covers and a sensor for sensing a leading edge of said plurality of boxes.

12. The apparatus of claim 8 wherein said hopper includes a plurality of generally vertically extending, adjustable guides.

13. The apparatus of claim 8 wherein said conveyor assembly includes a pair of spaced apart circulating chains, a drive assembly and a tensioning assembly for said chains.

14. An apparatus for mounting a premium package in a preformed opening in a product box comprising, in combination, means for receiving a plurality of said product boxes, means for engaging product in said product box through said preformed opening, means for installing a premium package in said opening in said product box, means for applying an adhesive cover to said premium package and said product box, and means for translating said product boxes between said receiving,-engaging, installing and applying means, whereby a premium in said package is visible on the outside of said product box.

15. The apparatus of claim 14 further including drive means for driving said engaging and said translating means and a phase adjustment device operably disposed between said drive means and said engaging means.

16. The apparatus of claim 14 wherein said translating means includes a pair of laterally adjustable, spaced apart guide rails.

17. The apparatus of claim 14 wherein said engaging means includes a reciprocating plunger adapted to engage said preformed opening in said product box.

18. The apparatus of claim 14 wherein said translating means includes a pair of spaced apart circulating chains and a plurality of product box engaging spaced apart transverse members.

19. The apparatus of claim 14 wherein said applying means includes a tape having a substrate and a plurality of adhesive covers and a drive mechanism for advancing said substrate.

20. The apparatus of claim 14 wherein said receiving means includes a hopper having a substantially upright wall member and at least two adjustable guide assemblies.

* * * * *